US008440112B2

(12) United States Patent
Noda et al.

(10) Patent No.: US 8,440,112 B2
(45) Date of Patent: May 14, 2013

(54) ELECTRODE MATERIAL FOR VACUUM CIRCUIT BREAKER AND METHOD OF MANUFACTURING THE SAME

(75) Inventors: Yasushi Noda, Hitachi (JP); Hiromasa Sato, Hitachi (JP)

(73) Assignee: Meiden T&D Corporation, Tokyo (JP)

( * ) Notice: Subject to any disclaimer, the term of this patent is extended or adjusted under 35 U.S.C. 154(b) by 97 days.

(21) Appl. No.: 13/126,515

(22) PCT Filed: Oct. 2, 2009

(86) PCT No.: PCT/JP2009/067590

§ 371 (c)(1),
(2), (4) Date: Apr. 28, 2011

(87) PCT Pub. No.: WO2010/050352

PCT Pub. Date: May 6, 2010

(65) Prior Publication Data

US 2011/0204299 A1 Aug. 25, 2011

(30) Foreign Application Priority Data

Oct. 31, 2008 (JP) ..... 2008-280863

(51) Int. Cl.
*H01B 1/02* (2006.01)

(52) U.S. Cl.
USPC ..... 252/518.1; 420/428

(58) Field of Classification Search .. 252/518.1; 419/32, 419/38, 57; 420/428, 495
See application file for complete search history.

(56) References Cited

U.S. PATENT DOCUMENTS

| | | | | | |
|---|---|---|---|---|---|
| 5,092,921 | A | * | 3/1992 | Kobayashi et al. | 75/623 |
| 5,391,215 | A | * | 2/1995 | Kobayashi et al. | 75/623 |
| 5,853,083 | A | * | 12/1998 | Furusawa et al. | 200/264 |
| 2010/0270267 | A1 | * | 10/2010 | Noda | 218/123 |

FOREIGN PATENT DOCUMENTS

| | | | |
|---|---|---|---|
| CN | 1453385 | A * | 11/2003 |
| EP | 0426375 | * | 5/1991 |
| JP | 4-095318 | | 3/1992 |
| JP | 5-242772 | | 9/1993 |
| JP | 2002-080923 | | 3/2002 |

* cited by examiner

*Primary Examiner* — Mark Kopec
(74) *Attorney, Agent, or Firm* — Brundidge & Stanger, P.C.

(57) ABSTRACT

Atomized Cu—Cr alloy powder, 20 to 30 percent by weight of Thermite Cr powder and 5 percent by weight of electrolytic Cu powder are mixed together and undergo solid phase sintering treatment to form an electrode material for vacuum circuit breakers. The gross content of Cr of the electrode material is 30 to 50 percent by weight. In manufacturing the electrode material for vacuum circuit breakers, such powders are mixed together and then undergo compression molding to be formed into a compressed compact. The compressed compact is performed solid phase sintering at a temperature lower than the melting point of Cu in a non-oxidizing atmosphere to prepare a solid phase sintered body.

2 Claims, 3 Drawing Sheets

ELECTRODE MATERIAL FOR VACUUM CIRCUIT BREAKER AND METHOD OF MANUFACTURING THE SAME

TECHNICAL FIELD

The present invention relates to an electrode material for vacuum circuit breakers and a method of manufacturing the same and more particularly to an electrode material for vacuum circuit breakers that uses copper-chromium alloy (Cu—Cr alloy) and a method of manufacturing the same.

BACKGROUND ART

In general, Cu—Cr sintered alloy is used in electrode material for vacuum circuit breakers. Such Cu—Cr sintered alloy is prepared in a manner: providing a powder mixture of Cu as a material having good conductivity and Cr as an arc-resisting component blended in a proper content ratio, compacting the powder mixture into a predetermined shape of compressed compact, and sintering the compressed compact in a non-oxidizing atmosphere such as vacuum. The Cu—Cr sintered alloy thus prepared is worked into an electrode.

The electrode material for vacuum circuit breakers of Cu—Cr sintered alloy of this fashion is known for its excellent suitability for the electrode use, because making Cr grain size therein fine for homogeneous metal texture can enhance the electrical properties of the alloy such as current interrupting performance and dielectric strength performance.

If Cr content is increased more than 40 percent by weight intending to prepare a Cu—Cr sintered alloy of high Cr content having good electrical properties, the sintered density of the alloy does not become high enough because of voids that will appear in the sintering treatment. Rolling the Cu—Cr sintered alloy intending to bring its density high, as a measure against this problem, is not good enough. Such treatment still has a disadvantage in that making the metal texture homogeneous is prevented by the aggregation of Cr caused from rolling.

If Cr powder of 10 μm or smaller in grain size is used in manufacturing Cu—Cr sintered alloy by an ordinary solid phase sintering process after mixing Cu powder and Cr powder together, oxidation process of Cr powder will occur making progress of sintering difficult with oxygen content increased. This invites poor electrical properties such as in the current interrupting performance and dielectric strength performance.

To overcome these problems, a material for electrical contact and manufacture thereof has been proposed in JP 04-95318 (Patent literature 1). In the art proposed in Patent literature 1, Cu—Cr sintered alloy uses atomized Cu—Cr alloy powder in which Cr of average particle diameter less than 5 μm is dispersed in a Cu-base metal (matrix). This atomized Cu—Cr alloy powder is prepared by the processes of: mixing 0.1 to 37 percent by weight of Cr powder with Cu powder, melting the powder mixture in inert gas atmosphere or vacuum, and solidifying the molten metal of the mixture with a rapid solidification method using an atomizer.

An atomized Cu—Cr alloy powder that includes 5 to 20 percent by weight of Cr is sintered intending to prepare an electrode material having improved electrical properties such as current interrupting performance, wherein the material contains homogeneously dispersed fine grain of Cr the average particle diameter of which in the Cu-base metal of the sintered compact is 2 to 20 μm.

As Patent literature 1 describes, the electrode material for vacuum circuit breakers made of Cu—Cr alloy powder prepared by atomizing process followed by solid phase sintering has an advantage of having good electrical properties. The Cu—Cr sintered alloy however has a problem in that manufacturing Cu—Cr sintered alloy of high Cr content is not practicable, because it is difficult to homogeneously disperse fine grain of Cr to a gross content of 30 percent by weight or more.

In atomizers usually used in mass production, it is their processing limit to manufacture Cr alloy powder containing 20 percent by weight of Cu. If the Cr content is increased more than that, the nozzle of such atomizer for spraying molten metal have a clogging problem.

There is another problem further to the clogging. If atomized Cu—Cr spherical powder is prepared with addition of Cu powder, which is a material having good press moldability and aggregability, intending to improve sinterability, the gross content of Cr in Cu—Cr sintered alloy will largely decrease with obtaining good electrical properties prevented.

An object of the present invention is to provide an electrode material for vacuum circuit breakers along with a method of manufacturing the same that is able to satisfy requirements by vacuum circuit breakers regarding low contact resistance value with improved electrical properties such as high-current interrupting performance and dielectric strength performance.

DISCLOSURE OF INVENTION

The electrode material for vacuum circuit breakers by the present invention is a solid phase sintered body of atomized Cu—Cr alloy powder, 20 to 30 percent by weight of Thermite Cr powder and 5 percent by weight of electrolytic Cu powder. The gross content of Cr in the solid phase sintered body is 30 to 50 percent by weight.

The method of manufacturing the electrode material for vacuum circuit breakers by the present invention includes: mixing atomized Cu—Cr alloy powder, 20 to 30 percent by weight of Thermite Cr powder and 5 percent by weight of electrolytic Cu powder together to form powder mixture; compression molding the powder mixture to form a compressed compact; and solid phase sintering the compressed compact in a non-oxidizing atmosphere at a temperature below the melting point of Cu to form a solid phase sintered body. The gross content of Cr in the solid phase sintered body is 30 to 50 percent by weight.

EFFECT OF INVENTION

In the electrode material for vacuum circuit breakers by the present invention, the gross content of Cr in the Cu—Cr sintered alloy can be increased and, moreover, it becomes practicable to disperse Cr of fine grain size in the Cu-base metal to make the metal texture have large grain sizes of Cr. Therefore, an electrode material for vacuum circuit breakers is given more improvements to its electrical properties such as high-current interrupting performance and dielectric strength performance suppressing increase in the contact resistance value.

Further, with the method of manufacturing the electrode material for vacuum circuit breakers by the present invention, Cu—Cr sintered alloy containing Cr in high-density can be easily manufactured in homogeneous metal texture.

BEST MODE FOR CARRYING OUT THE INVENTION

The electrode material for vacuum circuit breakers by the present invention is a material prepared by solid phase sintering to a compressed compact of a mixture of atomized Cu—Cr alloy powder, 20 to 30 percent by weight of Thermite Cr powder and 5 percent by weight of electrolytic Cu powder. The gross content of Cr in the solid phase sintered body is 30 to 50 percent by weight.

[Embodiment 1]

The following provides an explanation of the electrode material for vacuum circuit breakers and the method of manufacturing the same by the present invention. The electrode material for vacuum circuit breakers uses atomized Cu—Cr alloy powder, a well-known material, as the principal material. The atomized Cu—Cr alloy powder is manufactured by the processes listed as follows. Cu—Cr mixture is melted in inert gas atmosphere or vacuum. The molten metal of this mixture is jetted out from a spray nozzle called an atomizer. The jetted molten metal is then rapid quenched using compressed gas (gas atomization) or using water jet (water atomization). Thus, the alloy powder in which Cr is dispersed in the Cu-base metal is prepared.

The atomized Cu—Cr alloy powder is then used being mixed with proper amount of Thermite Cr powder prepared with reduction treatment applied to Cr oxide and electrolytic Cu powder prepared with electrolytic method.

These powders are treated with the manufacturing method that will be described later to prepare the electrode material for vacuum circuit breakers. The raw materials are processed to form a Cu—Cr solid phase sintered body for an electrode material for vacuum circuit breakers. In the final state after raw material mixing followed by solid phase sintering, the Cu—Cr solid phase sintered body so formed is given a metal texture containing properly dispersion-controlled Cr of fine grain size that will not lower current carrying performance and Cr of large grain size that will contribute to improvement of current interrupting performance and dielectric strength performance, with the gross content of Cr of 30 to 50 percent by weight.

To prepare a material the gross content of Cr in Cu—Cr solid phase sintered body of which is 30 to 50 percent by weight, mixture of atomized Cu—Cr alloy powder is used being mixed with 30 percent by weight of Thermite Cr powder for increasing Cr content and 5 percent by weight of electrolytic Cu useful for good moldability and higher compact density.

With this manner, manufacturing solid phase sintered body by solid phase sintering process is able to easily prepare the material for vacuum circuit breakers the gross content of Cr of which in solid phase sintered body is 30 to 50 percent by weight, because the amount of Cr in the atomized Cu—Cr alloy powder is inclusive of Thermite Cr powder.

Figure 1:
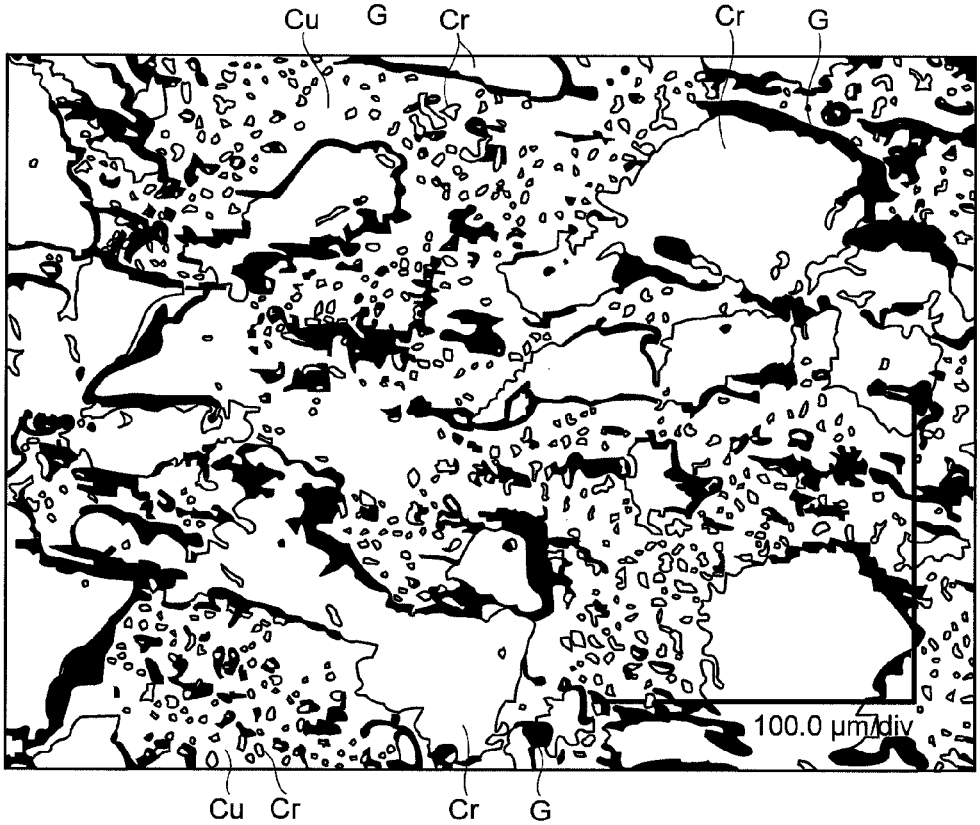
FIG. 1 is a schematic illustration of a micrograph of an electrode material for vacuum circuit breakers in an embodiment of the present invention.

As FIG. 1 schematically shows with a micrograph, the Cu—Cr solid phase sintered body for the electrode material for vacuum circuit breakers by the present invention has gained such a metal texture that Thermite Cr, shown as the whitened area in the figure, of about 80 μm in average grain size is homogeneously distributed in the interstices involved in the atomized Cu—Cr, shown as the grayed area in the figure, which is a disperse system of fine Cr of about 1 μm in size diffused in Cu-base metal. The blackened area in the figure by or on the boundary between the atomized Cu—Cr and the Thermite Cr is gaps G created during sintering treatment.

Figure 2:
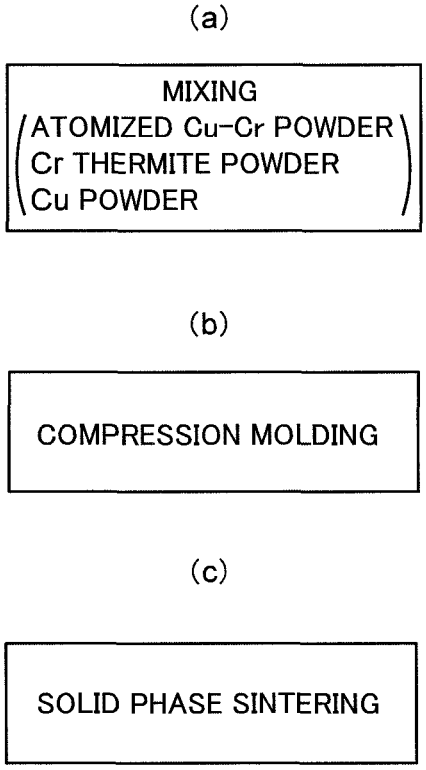
FIG. 2 is schematic diagrams of a method of manufacturing an electrode material for vacuum circuit breakers in an embodiment of the present invention.

The electrode material for vacuum circuit breakers by the present invention is manufactured following, for example, the treatment procedures shown in FIGS. 2(*a*) to (*c*). Firstly, as indicated in FIG. 2(*a*), 20 to 30 percent by weight of Thermite Cr powder and 5 percent by weight of electrolytic Cu powder are added to atomized Cu—Cr alloy powder prepared with a known manufacturing method to provide a compound of them and then the compound in a powder state is given mixing treatment to a homogeneous powder mixture.

Secondly, as indicated in FIG. 2(*b*), the powder mixture is charged in a mold having a predetermined shape and undergoes compression molding to be formed into a highly dense compressed compact. The compression molding is performed using a press with a pressure of approximately 4 t/cm$^2$ for 10-second or shorter.

Lastly, as indicated in FIG. 2(*c*), the compressed compact is heated at a temperature lower than the melting point of Cu, in a non-oxidizing atmosphere like inert gas or vacuum, to undergo solid phase sintering treatment so that Cu—Cr solid phase sintered body the gross content of Cr of which is 30 to 50 percent by weight will be prepared.

As stated above, addition of 5 percent by weight of electrolytic Cu powder to atomized Cu—Cr alloy powder makes it practicable to improve both the moldability of the powder mixture and the sintered density. In addition, performing solid phase sintering treatment to the compressed compact at a temperature lower than the melting point of Cu produces a homogeneous texture with gaps largely reduced because such treatment condition makes the entirety of the compressed compact become massed together.

Furthermore, the solid phase sintered body as the electrode material for vacuum circuit breakers manufactured by solid phase sintering treatment applied to atomized Cu—Cr alloy powder with Thermite Cr powder added thereto has such a metal texture that Thermite Cr of large grain size is homogeneously distributed in the interstices involved in atomized Cu—Cr, which is a disperse system of fine Cr diffused in Cu-base metal.

Moreover, the manufacturing of the Cu—Cr sintered bode having the gross content of Cr of 30 to 50 percent by weight followed by hot isostatic pressing (HIP) treatment, a well-known pressing treatment, makes the solid phase sintered body highly dense. Such material property is more advantageous in an electrode material for vacuum circuit breakers.

Figure 3:
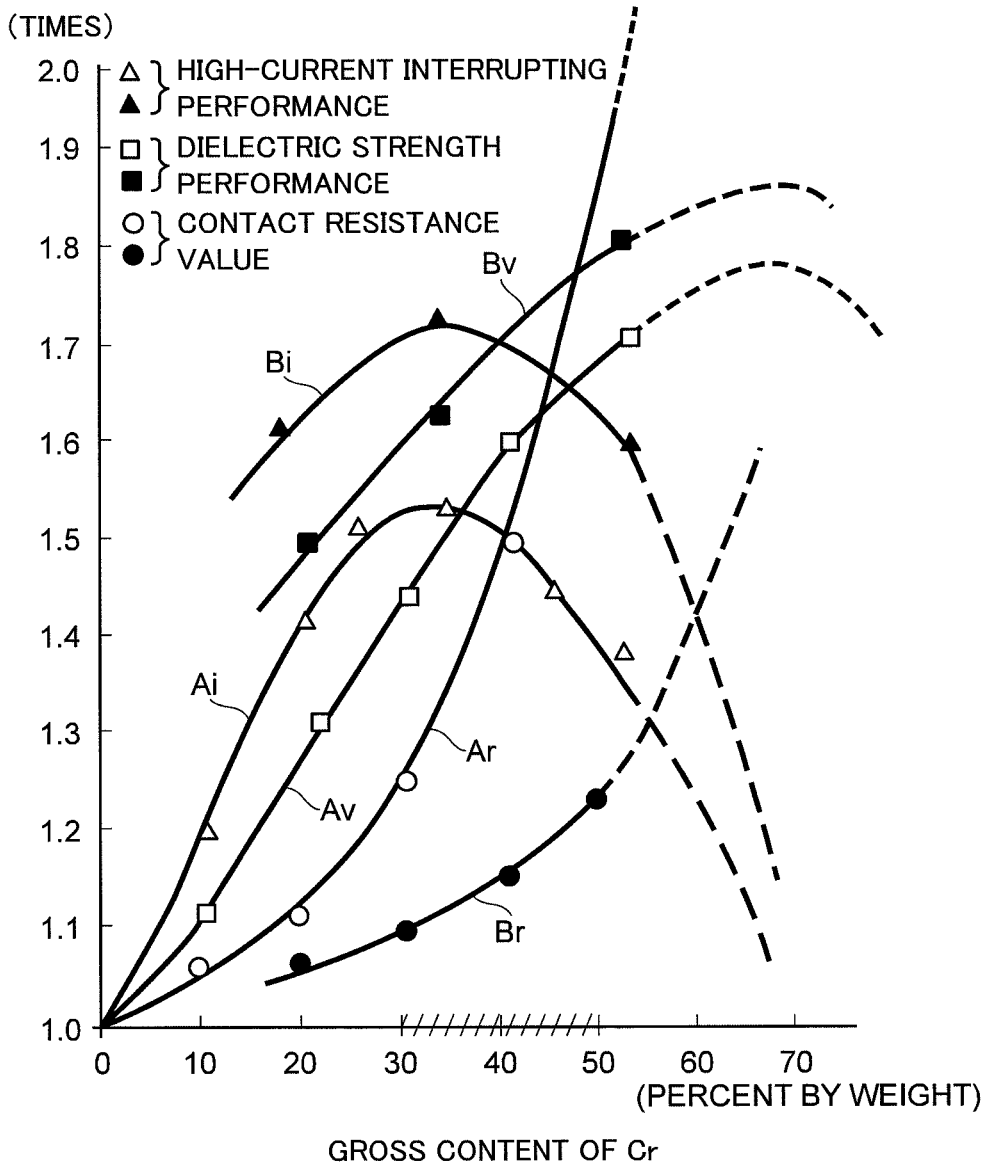
FIG. 3 is a property diagram that shows the high-current interrupting performance, the dielectric strength performance, and the contact resistance value of a Cu—Cr electrode material for vacuum circuit breakers.

FIG. 3 shows electrical properties demonstrated by samples of electrode material for vacuum circuit breakers having different Cr grain sizes. The plotted electrical properties are high-current interrupting performance, dielectric strength performance, and contact resistance value. The properties are expressed in the property-ratio defining the properties of the no-Cr material as 1. In the figure, the abscissa represents the gross content of Cr in the Cu—Cr solid phase sintered compact and the ordinate represents property-ratio of the sample to the vacuum circuit breaker electrode Cu material containing no Cr.

In this FIG. 3, the property measurements on Sample A are indicated as the curves Ai, Av, and Ar respectively for the high-current interrupting property, the dielectric strength, and the contact resistance value. Sample A was obtained with a conventional method and the Cu—Cr solid phase sintered compact thereby includes Cr of about 50 to 100 μm in grain size. The measured properties are plotted using white triangles to denote the high-current interrupting performances, white squares dielectric strength performances, and white circles contact resistance values. The curve Ai for representing the high-current interrupting property is drawn connecting white triangles, the curve Av for dielectric strength white squares, and the curve Ar for contact resistance value white circles.

Likewise, the property measurements on Sample B are indicated as the curves Bi, Bv, and Br respectively for the high-current interrupting property, the dielectric strength, and the contact resistance value. Sample B was obtained with the method defined in the present invention and the Cu—Cr solid phase sintered compact thereby includes Cr in mixed grain sizes of about 50 to 100 μm and several μm or smaller. The measured properties are plotted using black triangles to denote the high-current interrupting performances, black squares dielectric strength performances, and black circles contact resistance values. The curve Bi for representing the high-current interrupting property is drawn connecting black triangles, the curve Bv for dielectric strength black squares, and the curve Br for contact resistance value black circles.

As the property curves for Sample A, which includes Cr of larger grain size only, clearly indicate that the high-current interrupting properties on curve Ai shows its peak when the gross content of Cr is 30 percent by weight and decreases thereafter, that the dielectric strength on curve Av, which is drawn connecting white squares, progressively increases, and that the contact resistance value Ar sharply increases after 20 percent by weight.

In contrast, the property curves of Sample B in the present invention, the texture of which includes Cr of both larger and smaller grain sizes, indicate that the high-current interrupting properties on curve Bi shows a similar tendency to that of Sample A as the gross content of Cr decreases but with property-ratios larger than that in curve Ai, and that the property-ratio of the dielectric strength on curve Bv is larger than those of Sample A; however, the rate of increase of the property-ratio of the contact resistance value on curve Br is greatly lower than that of Sample A. These show that Sample B provides desirable electrical properties.

The electrode material for vacuum circuit breakers by the present invention is a solid phase sintered body, the principal component of which is atomized Cu—Cr alloy powder. To the atomized Cu—Cr alloy powder, Thermite Cr powder and electrolytic Cu powder are added to prepare a powder mixture, which then undergoes solid phase sintering treatment to prepare the solid sintered body. The gross content of Cr therein is controlled between 30 to 50 percent by weight, and about half of the gross content is made to be occupied by fine-grain Cr and the rest by large-grain Cr. This feature provides more improved high-current interrupting performance and dielectric strength performance compared to a conventional electrode material for vacuum circuit breakers and permits realization of a use with excellent electrical properties with lessened increase in contact resistance value.

INDUSTRIAL APPLICABILITY

The electrode material for vacuum circuit breakers and the method of manufacturing the same by the present invention are effective because they are applicable widely to vacuum circuit breakers that handle high-voltages and high-currents and are suitable for manufacturing Cu—Cr sintered alloy that includes Cr in highly dense content.

The invention claimed is:

1. An electrode material for vacuum circuit breakers, the electrode material being prepared by solid phase sintering of atomized Cu—Cr alloy powder, 20 to 30 percent by weight of a metal Cr powder formed by thermite reduction and 5 percent by weight of electrolytic Cu powder, wherein the gross content of Cr in the solid phase sintered body is 30 to 50 percent by weight.

2. A method of manufacturing an electrode material for vacuum circuit breakers, comprising the steps of:

mixing atomized Cu—Cr alloy powder, 20 to 30 percent by weight of a metal Cr powder formed by thermite reduction, and 5 percent by weight of electrolytic Cu powder to form a powder mixture;

compression molding the powder mixture to form a compressed compact; and solid phase sintering the compressed compact in a non-oxidizing atmosphere at temperature below the melting point of Cu to form a solid phase sintered body, in which the gross content of Cr in the solid phase sintered body is 30 to 50 percent by weight.

* * * * *